US005609463A

United States Patent [19]

Kobayashi et al.

[11] Patent Number: 5,609,463

[45] Date of Patent: Mar. 11, 1997

[54] METHOD OF SUPPLYING PARTS AND SUPPLYING DEVICE

[75] Inventors: Haruhito Kobayashi; Yoshinobu Ohta; Shigeharu Nakahira, all of Yokkaichi, Japan

[73] Assignee: Sumitomo Wiring Systems, Ltd., Japan

[21] Appl. No.: 359,894

[22] Filed: Dec. 20, 1994

[30] Foreign Application Priority Data

Dec. 28, 1993 [JP] Japan ..... 5-350005

[51] Int. Cl.[6] ..... G06M 1/00

[52] U.S. Cl. ..... 414/675; 414/225; 414/786; 29/821

[58] Field of Search ..... 414/225, 416, 414/675, 786; 29/DIG. 42, 821

[56] References Cited

U.S. PATENT DOCUMENTS

| | | | |
|---|---|---|---|
| 2,510,555 | 6/1950 | Christie | 29/DIG. 46 |
| 2,706,072 | 4/1955 | Furno | 414/675 |
| 3,150,785 | 9/1964 | Clasen | 414/675 |
| 3,233,752 | 2/1966 | Lagler et al. | 414/225 |
| 3,239,079 | 3/1966 | Leavesley, Jr. et al. | 414/225 |
| 3,272,360 | 9/1966 | van der Schoot | 414/416 |
| 3,468,024 | 9/1969 | Yonkers | 29/821 |
| 3,508,314 | 4/1970 | Powell, Jr. | 414/675 |
| 3,667,103 | 6/1972 | Petree | 29/DIG. 46 |
| 3,797,683 | 3/1974 | Simpatico | 414/416 |
| 4,653,182 | 3/1987 | Fukuda et al. | 29/754 |
| 4,982,553 | 1/1991 | Itoh | 414/416 |
| 5,007,164 | 4/1991 | Kato . | |
| 5,085,312 | 2/1992 | Ribordy et al. | 414/225 |
| 5,155,895 | 10/1992 | Jakiela et al. | 29/821 |
| 5,295,865 | 3/1994 | Endo et al. . | |

FOREIGN PATENT DOCUMENTS

| | | | |
|---|---|---|---|
| 1526944 | 9/1989 | U.S.S.R. | 29/821 |

*Primary Examiner*—David A. Bucci
*Assistant Examiner*—Douglas Hess
*Attorney, Agent, or Firm*—Anthony J. Casella; Gerald E. Hespos

[57] ABSTRACT

Recesses 12 are formed on an upper surface 10*a* of a turntable 10 detachably mountable on a support member 20. The recesses 12 are arranged at a pitch of a specified angle θ on a plurality of concentric circles C1 to C4 centered on a longitudinal axis 11. The turntable 10 is slid along an x-axis by an air cylinder 80 and is intermittently rotated by the specified angle θ by an air motor 40. In this way, a desired recess 12 can be moved to a receiving position P. The waterproof plugs can be securely supplied. A preparation for changing the kind of the waterproof can be made only by replacing the turntable, with the result that the preparation can be easily made within a short period of time.

12 Claims, 7 Drawing Sheets

METHOD OF SUPPLYING PARTS AND SUPPLYING DEVICE

BACKGROUND OF THE INVENTION

1. Field of the Invention

The present invention relates to a method of supplying parts and to a supplying device, particularly to a waterproof plug supplying device for supplying waterproof plugs used mainly for a wiring harness of an automotive vehicle to a device for automatically attaching the supplied waterproof plug to an electric wire.

2. Description of the Prior Art

As the above waterproof plug supplying device, there have been disclosed parts feeders in which the waterproof plugs are aligned in a line along a conveyance path and are fed one after another to a transfer position located at the first in the line as shown in (1): FIG. 1 of Japanese Unexamined Patent Publication No. 2-75181, (2): FIG. 1 of Japanese Unexamined Patent Publication No. 2-75182, and (3): FIG. 6 of Japanese Unexamined Utility Model Publication No. 60-168286.

However, in the parts feeders disclosed in the above publications (1) to (3), the waterproof plugs aligned in a line are respectively fed by being pushed forward by the succeeding waterproof plugs. This has caused the following problems. The waterproof plug is normally made of rubber and a flash may remain in a parting line formed during the molding. There have been cases where the waterproof plugs fall forward on the conveyance path because the flash catches the inner wall of the conveyance path or the other waterproof plug or because of the vibration of the feeder itself. In this case, the fallen waterproof plugs may be conveyed to the transfer position or may cause a jam on the conveyance path. As a result, the waterproof plugs cannot be supplied properly.

In order to smoothly convey the waterproof plugs along the conveyance path, there has been proposed a parts feeder in which a guide rail is provided at the bottom surface of the conveyance path. The conveyance path and each waterproof plug is provided with a contact portion formed of synthetic resin such that it can be slidably guided by the guide rail (see the disclosure on left column, page 3 and FIGS. 1, 4 and 5 of Japanese Unexamined Patent Publication No. 5-77858 (Publication (4)). However, this parts feeder employs a design change with which the waterproof plug is comprised of a plurality of parts, making the structure thereof complicated. This has lead to an increased production cost.

Any one of the parts feeders disclosed in the publications (1) to (4) is adapted to the specification (shape and size) of the waterproof plugs, and there are 70 to 80 different specifications for the waterproof plugs. Thus, it was necessary to prepare a multitude of parts feeders. Further, when the specification of the waterproof plugs to be attached is changed, a parts feeder in the device for attaching the waterproof plugs to the electric wires must be entirely changed to the one suitable for the changed waterproof plugs. Thus, the replacement has taken a lot of cost and time. Particularly, in the production of the wiring harness, a wide variety of waterproof plugs have, in recent years, been produced each in a small quantity and the number of replacement has been exceedingly increased. Therefore, a long replacement time leads to a reduction in the projection efficiency.

It is an object of the invention to provide a method of supplying parts and a supplying device, particularly a waterproof plug supplying device, which are capable of securely supplying parts, particularly waterproof plugs without necessitating any design change in the parts and with which replacement can be easily made within a short period of time when the kind of the parts is changed.

SUMMARY OF THE INVENTION

The above object is accomplished by a method of supplying parts and by a supplying device as described and claimed herein.

The device includes a supply means with an upper surface having recesses for accommodating parts. A vibration means gives a minute vibration to the supply means after a specified number of parts are supplied on the upper surface of the supply means. These vibrations cause the respective parts to be accommodated in the recesses. Subsequently, a desired recess may be moved to a specified receiving position of a conveyance means, preferably by shift means, so that the conveyance means is able to receive the parts in the recesses.

In the prior arts (1) to (3), improper feeds have occurred due to the waterproof plugs falling forward since the waterproof plugs are fed while being pushed forward by the succeeding ones. However, according to the invention:

a) The parts can be securely supplied since the parts are supplied while being individually accommodated in the recesses, b) Unlike the prior art (4), it is not necessary to devise a design change, e.g., to form in the parts, e.g., in a waterproof plug a sliding portion of synthetic resin to facilitate the guiding, c) All the parts can be picked up at a single set receiving position since a desired recess can be moved to the receiving position, and d) Particularly, since the parts are orderly arranged in a specified manner, it is easy to access the parts for supplying them to the conveyance means. Preferably, a shift means moves the supply means at a specified feed pitch corresponding to an arrangement pitch of the parts.

Preferably, the supply means is detachably mountable, so that the change in the kind of the parts (waterproof plugs) can be coped with only by replacing the supply means. As a result, compared to the conventional case where the entire parts feeder is replaced, a replacement time required to change the kind of the parts can be considerably reduced. This leads to an improvement in the operation efficiency of the device, particularly for attaching waterproof plugs to electric wires.

Preferably, the supply means includes a turntable rotatably supported on the support means about a specified longitudinal axis, the recesses are arranged circumferentially at a pitch determined by a specified angle on the arcs of a plurality of concentric circles centered on the longitudinal axis, and the shift means includes drive means for intermittently rotating the turntable about the longitudinal axis by the specified angle and slide means for sliding the turntable in its radial direction.

With this construction, after being slid so that a desired concentric circle is located at the receiving position of the conveyance means, the turntable is intermittently rotated by the specified angle by the drive means, thereby moving the recesses arranged on this desired concentric circle to the receiving position one after another. Thus, the waterproof plugs accommodated in the respective recesses can be taken out one after another. This construction demonstrates the following effect in addition to the effects a) to d) of the invention described above because of the fact that the supply means includes a turntable. In order to move the recesses on the same concentric circle to the receiving position, it is sufficient for the turntable to rotate at the same position. Since the turntable needs not be moved in a direction other than that of the sliding movement, a smaller space is required therefor.

It is further preferred that there are prepared a plurality of kinds of supply means including recesses having different shapes and sizes corresponding to different kinds of waterproof plugs, the recesses are arranged at the same positions in each of the different supply means, and the depth of the recesses in the different supply means is set such that the upper faces of the waterproof plugs accommodated in the recesses are at the same height whatever supply means is used.

This construction demonstrates the following effect in addition to the effects of the invention as described above. Since the waterproof plugs in the recesses are located at the same positions and the upper faces thereof are at the same height even when the supply means is changed in changing the kind of the waterproof plugs, the operation of the conveyance means needs not be changed, thereby obviating the need to make preparation for this purpose.

Preferably, the parts supplied by the inventive method and device, respectively, are those kinds of parts the material of which may cause problems when being fed by being pushed forward by succeeding parts along a conveyance path. Typically, this is the case when the parts are made of rubber. Typical examples for rubber type parts are waterproof plugs used mainly for wiring harnesses.

BRIEF DESCRIPTION OF THE DRAWINGS

These and other objects, features and advantages of the present invention will become more apparent upon a reading of the following detailed description and accompanying drawings in which.

DETAILED DESCRIPTION OF THE PREFERRED EMBODIMENT

Figure 1:
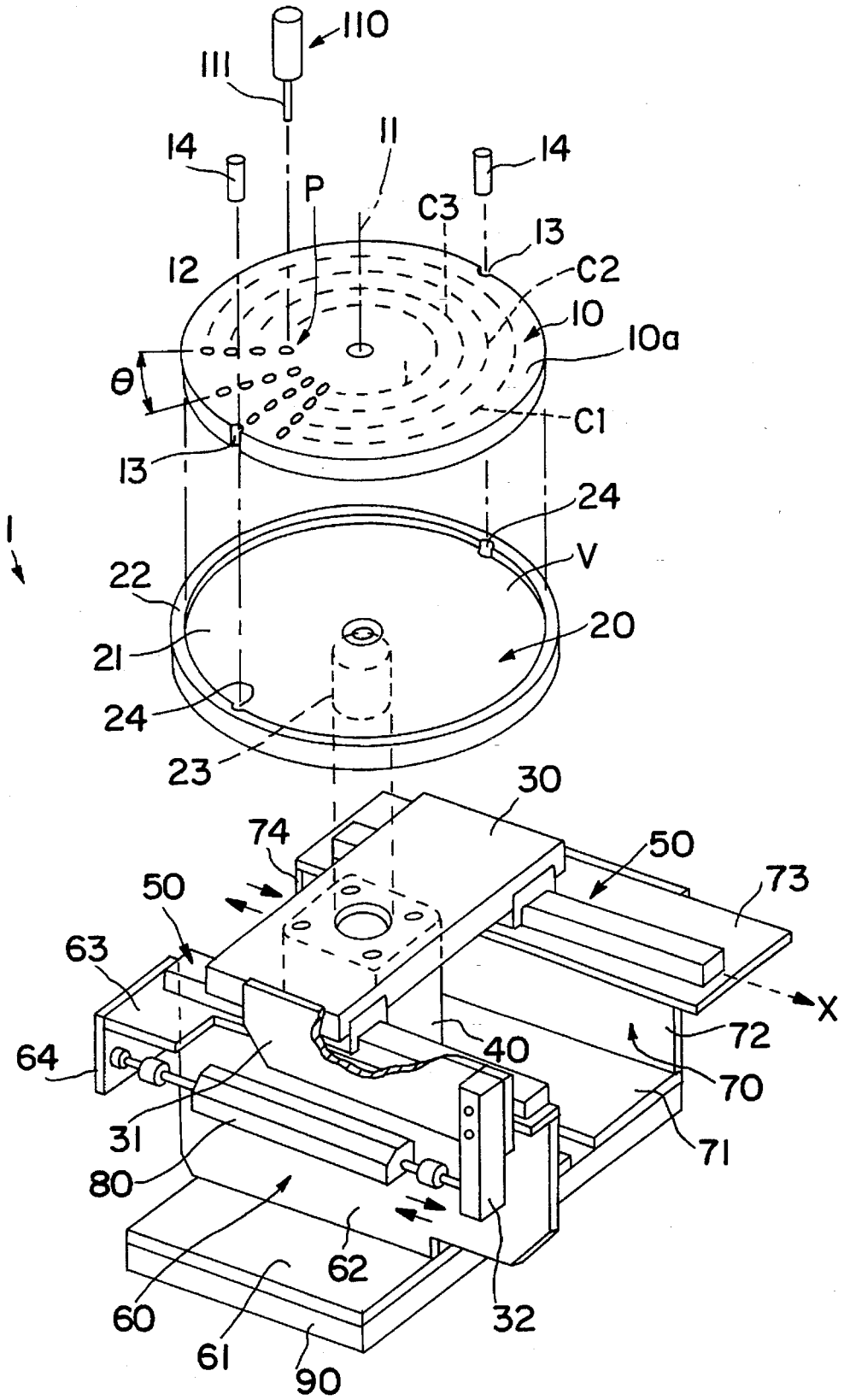
FIG. 1 is a partially exploded perspective view showing a waterproof plug supplying device according to an embodiment of the invention, FIGS. 2(*a*) and 2(*b*) are diagrams schematically showing the shape of a waterproof plug, FIG. 2(*a*) being a partially cutaway side view and FIG. 2(*b*) a plan view.
Figure 8:
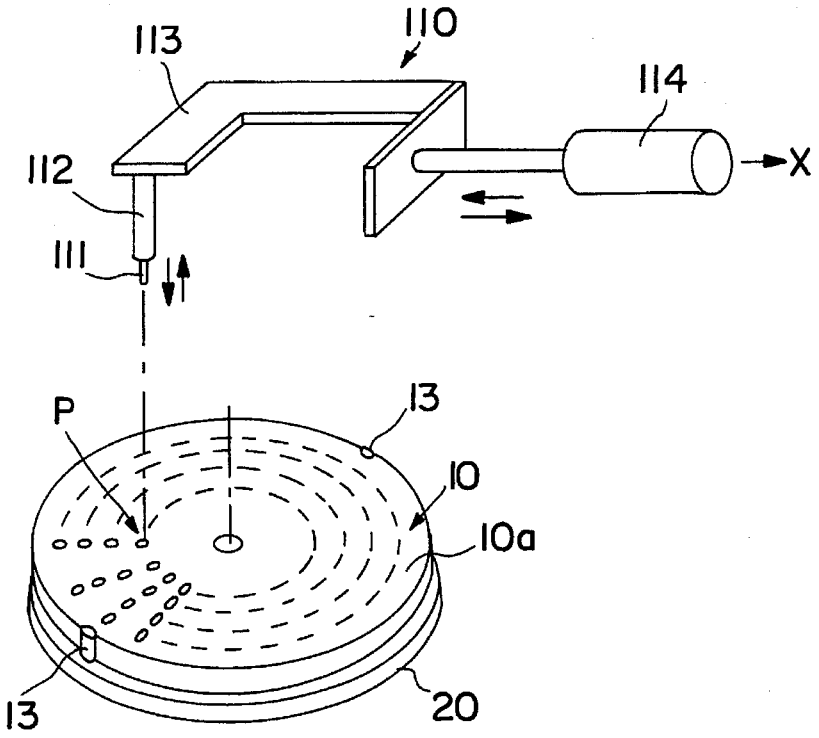
FIG. 8 is a schematic perspective view showing the turntable and the conveying device.

In FIG. 1, the waterproof plug supplying device 1 is such that rubber made waterproof plugs 2 held on a turntable 10 are moved one by one to a specified receiving position P to be received by a conveying device 110 (see FIG. 8) for receiving and conveying the received waterproof plug to a plug attaching device (not shown).

Figure 2A:
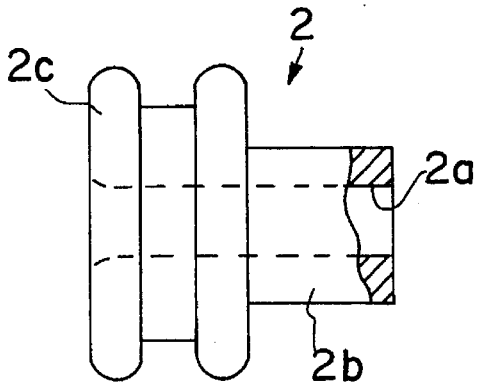
Figure 2B:
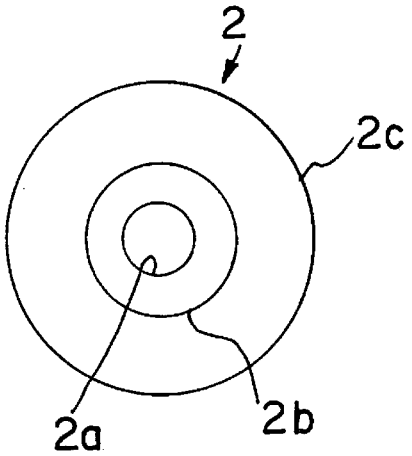
Figure 3:
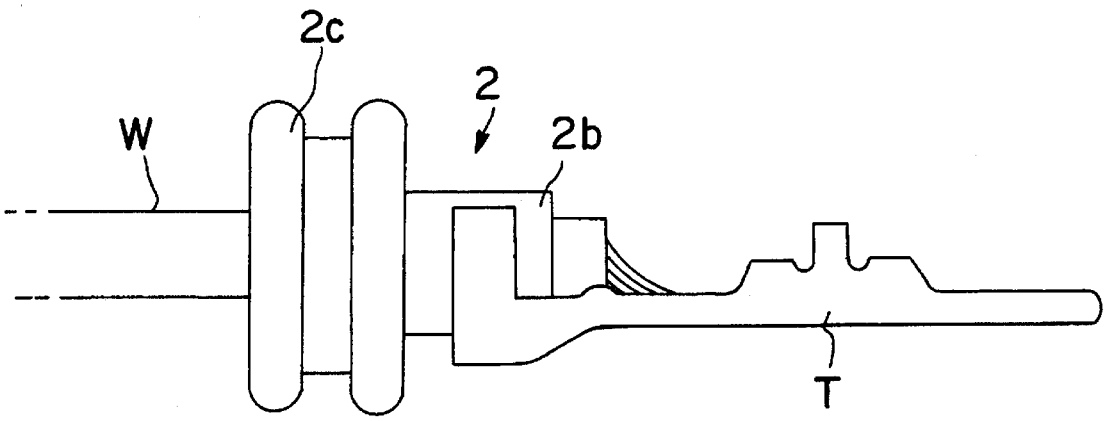
FIG. 3 is a schematic side view showing an end of an electric wire to which the waterproof plug and a terminal are attached.

As shown in FIGS. 2(*a*) and 2(*b*), each plug 2 has a cylindrical body having an insertion hole 2*a* in which an electric wire is inserted. The plug 2 includes a small diameter portion 2*b* and a large diameter portion 2*c*. As shown in FIG. 3, after an electric wire W is inserted in the insertion hole 2*a*, the small diameter portion 2*b* is tightly secured with a terminal fitting T. Further, the large diameter portion 2*c* is formed with a plurality of sealing portions so that it may sealably be fitted to the inner wall of a connector.

With reference to FIG. 1, the supplying device 1 is provided with (1) a turn table 10 as supply means for holding a plurality of waterproof plugs 2 in recesses 12 in a specified arranged manner, (2) a support member 20 for supporting the turntable 10, the turntable 10 being detachably mountable on the support member 20, (3) a slide plate 30 for rotatably supporting the support member 20, (4) an air motor 40 which is mounted at the underside of the slide plate 30 and acts as drive means for drivingly rotating the turntable 10 by way of the support member 20, (5) a pair of frame members 60 and 70 for supporting the slide plate 30 by way of a pair of uniaxial (x-axis) slide mechanisms 50, (6) a base 90 on the upper surface of which the frame members 60 and 70 are secured, and (7) an air cylinder 80 as slide means which is provided between a fixed plate 64 fixed on the frame member 60 and a movable member 32 which moves integrally with the slide plate 30 to move the slide plate 30 forward and backward along the x-axis.

Figure 4:
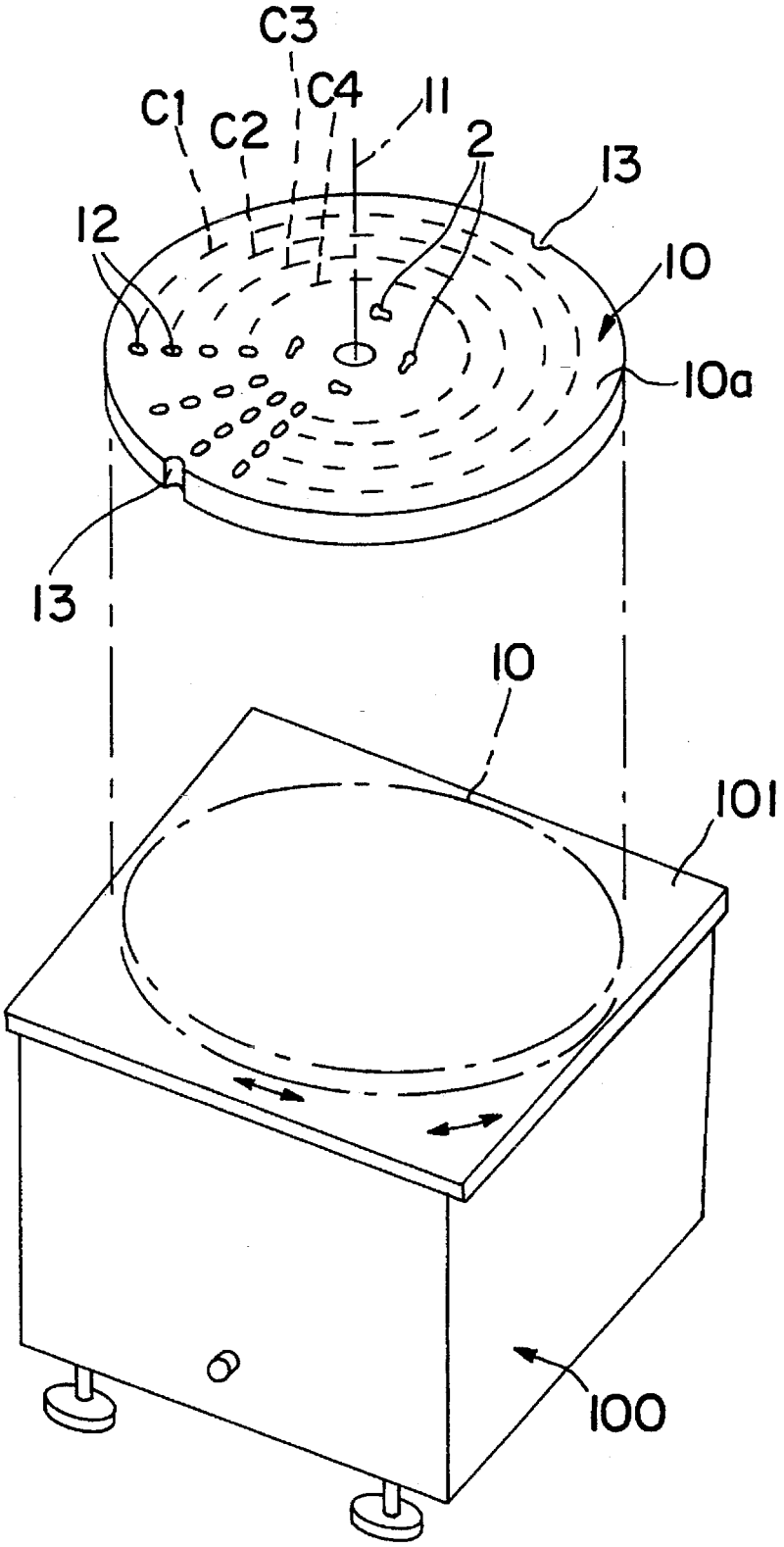
FIG. 4 is a schematic perspective view showing a turntable and a vibrator for vibrating the turntable.
Figure 5:
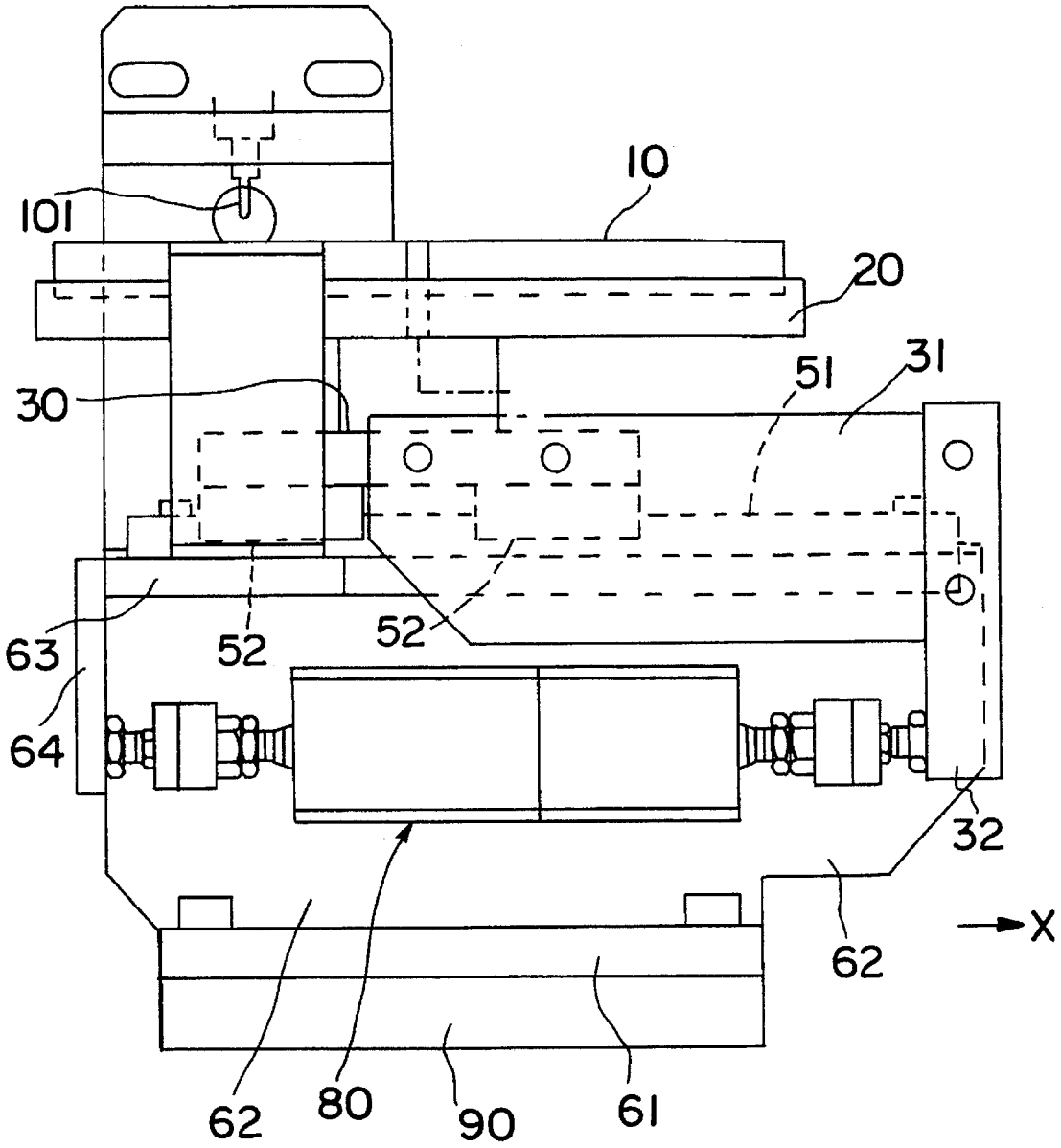
FIG. 5 is a front view showing the waterproof plug supplying device.

As shown in FIG. 4, the supplying device 1 is also provided with a known swing-type vibrator 100 for vibrating the turntable 10. The vibrator 100 vibrates the turntable 10 detached from the support member 20 so that the waterproof plugs supplied on the turntable 10 are accommodated in the recesses 12. The vibrator 100 may include the air motor 40 and the slide plate 30. Alternatively, the vibrator 100 may be adjacent to but structurally separate from the other parts of the supplying device shown in FIG. 1.

The turntable 10 includes a disk having a longitudinal axis 11 acting as a center of rotation. A plurality of recesses 12 for accommodating the waterproof plugs 2 are formed on an upper surface 10*a* of the turntable 10. These recesses 12 are arranged circumferentially at a specified pitch of angle θ (e.g., θ=15°) on the arcs of a plurality of concentric circles C1 to C4 centered on the longitudinal axis 11.

There are prepared a plurality of kinds of turntables 10 having recesses 12 of different shapes and different sizes corresponding to the different kinds of the waterproof plugs. The recesses 12 are arranged at the same positions in each of the different turntables 10.

The support member 20 includes: (1) a disk 21, (2) a periphery wall 22 extending upward from the outer periphery of the disk 21, and (3) a coupling shaft 23 which projects downward from the lower surface of the disk 21 and is coupled with the air motor 40 through the slide plate 30. A space V for holding the turntable 10 is defined by the upper surface of the disk 21 and the inner circumferential surface of the periphery wall 22.

Notches 13 having a semicircular horizontal cross-section are formed at two opposing position of the outer circumferential surface of the turntable 10. Similarly, notches 24 having a semicircular horizontal cross-section are formed at two positions corresponding to the positions of the notches 13 on the inner circumferential surface of the periphery wall 22 of the support member 20. Coupling pins 14 are inserted in holes defined by the corresponding notches 13 and 24, thereby restricting a movement of the turntable 10 held in the space V of the support member 20 relative to the support member 20.

Figure 9:
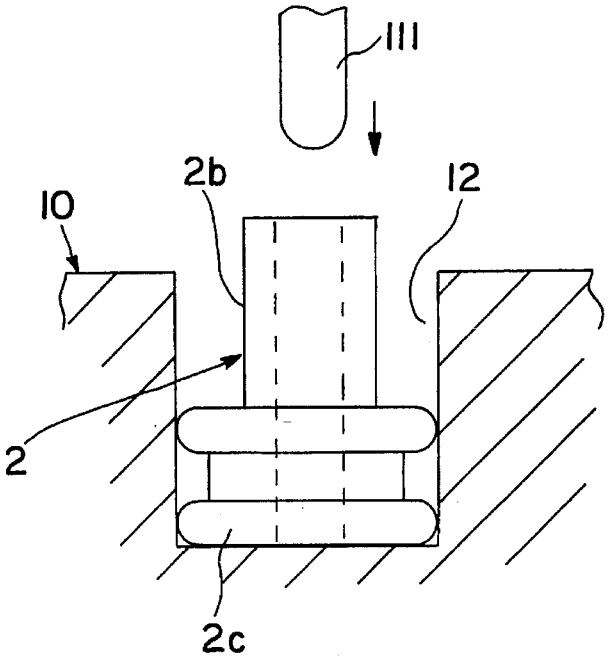
FIG. 9 is a schematic diagram showing an operation of picking up the waterproof plug accommodated in the recess by means of a pin member.

When the waterproof plugs 2 are to be accommodated in the recesses 12 of the turntable 10, the turntable detached from the support member 20 is placed on a vibration table 101 of the vibrator 100 as shown in FIG. 4. After a specified number of waterproof plugs 12 are supplied on the upper surface 10*a* of the turntable 10, the vibrator 100 gives given horizontal and vertical vibrations and a given swinging movement (swinging angle of about 10°). Upon being subjected to these vibrations, the waterproof plugs 2 are securely accommodated in the recesses 12 such that the small diameter portions 2*b* face upward as shown in FIG. 9.

Figure 6:
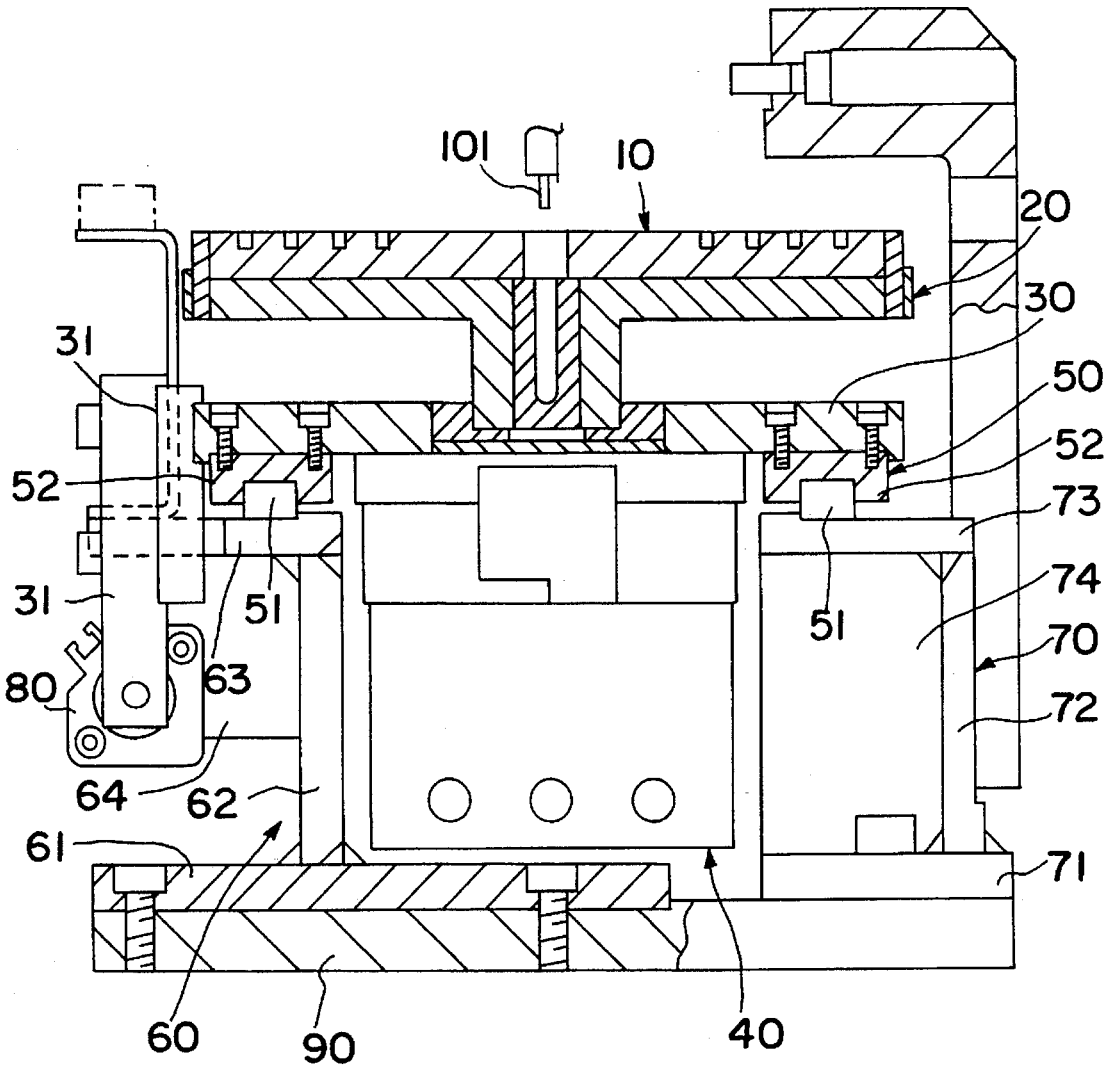
FIG. 6 is a side view partly in section showing the waterproof plug supplying device.

With reference to FIGS. 1 and 6, the frame member 60 includes: (1) a lower plate 61 screwed on the upper surface of the base 90, (2) a side plate 62 secured on the upper surface of the lower plate 61 by means of welding, (3) a support plate 63 secured on the upper surface of the side plate 62 by means of welding, and (4) the fixed plate 64 secured on end faces of the side plate 62 and the support plate 63 by means of welding.

The frame member 70 includes: (1) a lower plate 71 screwed on the upper surface of the base 90, (2) a side plate 72 secured on the upper surface of the lower plate 71 by means of welding, (3) a support plate 73 secured on the upper surface of the side plate 72 by means of welding, and (4) an end plate 74 secured on end faces of the side plate 72 and the support plate 73 by means of welding.

Figure 7:
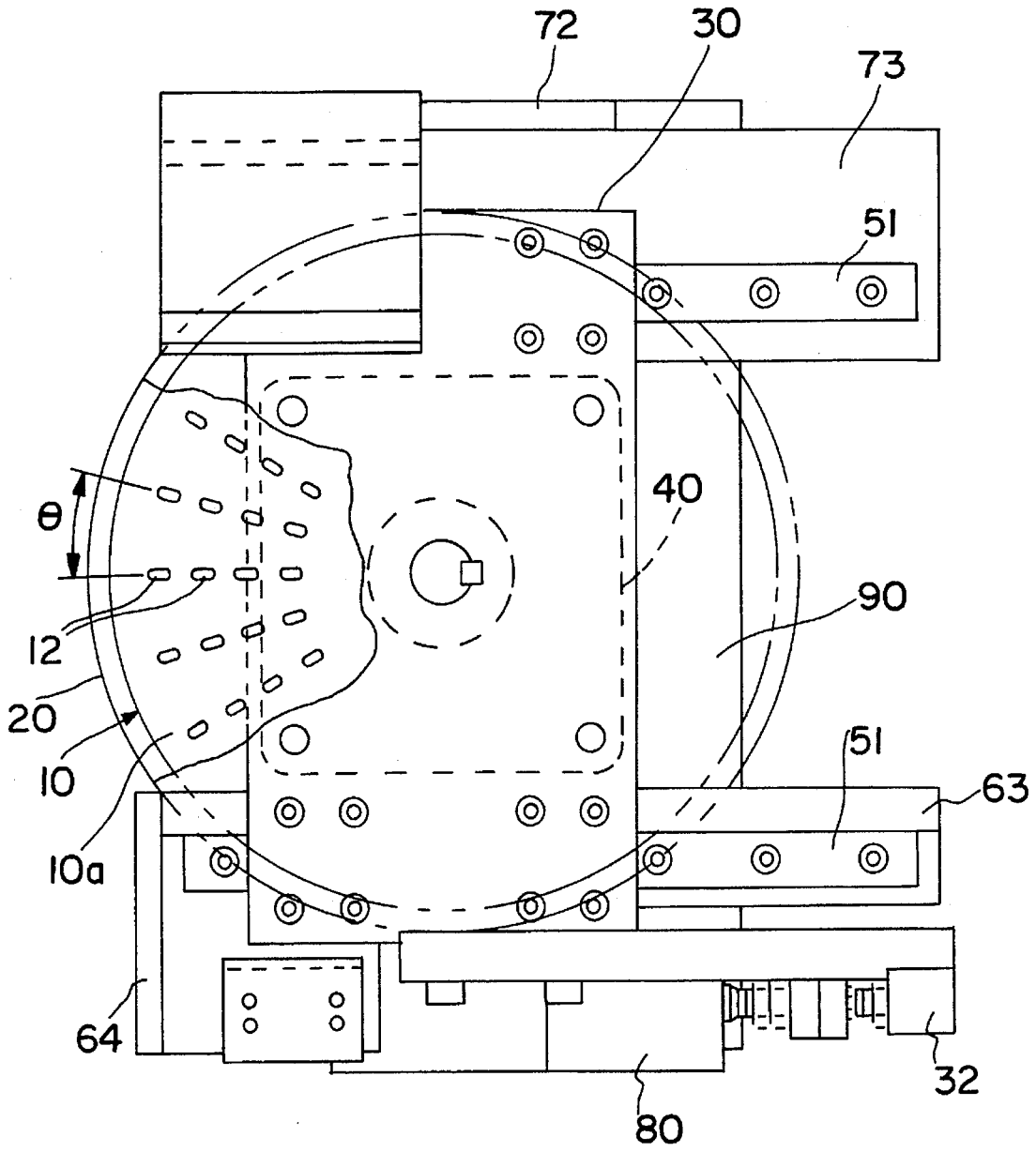
FIG. 7 is a partial plan view showing the waterproof plug supplying device.

With reference to FIGS. 1, 6 and 7, each slide mechanism 50 includes: (1) two slide rails 51 secured to the support plates 63 and 73 and (2) a slider 52 having a channel-like cross-section which is slidably fitted on the slide rails 51 and is screwed to the lower surface of the slide plate 30.

With reference to FIGS. 1, 5, 6 and 7, a coupling plate 31 is secured at one lateral side of the slide plate 30 by means of welding and the movable member 32 is screwed to one end of the side surface of the coupling plate 31.

The air motor 40 rotates the turntable 10 by the specified angle in accordance with a detection value of an unillustrated known rotational displacement sensor.

The air cylinder 80 moves the turntable 10 to a specified position in accordance with a detected value representative of a displacement of the turntable 10 in the x-axis direction by an unillustrated known device for measuring a displacement (e.g., a potentiometer).

The conveying device 110 (see FIG. 8) for conveying the waterproof plugs to the unillustrated attaching device includes: (1) a pin member 111 as a means for receiving the waterproof plug at the receiving position, (2) an elevating air cylinder 112 for moving the pin member 111 upward and downward, (3) a mount member 113 on which the elevating cylinder 112 is mounted, and (4) an air cylinder 114 for moving the pin member 111 forward and backward along the x-axis by way of the mount member 113. The pin member 111 is inserted in the insertion hole 2*a* of the waterproof plug 2 and takes the waterproof plug 2 from the recess 12 while holding it from the inside. Since the upper face of the waterproof plug 2 is at the same height regardless of the kind thereof, it is sufficient for the elevating cylinder 112 to have a fixed stroke. The pin member 111 is, at first, moved downward by the cylinder 112 at the specified receiving position P located on the innermost concentric circle C4 of the turntable 10. After catching the waterproof plug 2 by fitting in the insertion hole 2*a*, the pin member 111 is moved upward and is then moved to the attaching apparatus in the x-axis direction by the air cylinder 114.

The operation of the supplying device 1 is described.

First, as shown in FIG. 4, the turntable 10 alone is placed on the vibration table 101 of the vibrator 100 and a specified number of waterproof plugs 2 are supplied on the upper surface 10*a* of the turntable 10. Thereafter, the vibrator 100 gives minute vibrations to the turntable 10, with the result that the respective waterproof plugs are accommodated in the recesses 12. The turntable 10 carrying the waterproof plugs 2 is mounted on the support member 20, thereby completing the preparation. By preparing the turntable 10 carrying the waterproof plugs 2 accommodated in the recesses 12 as a result of being subjected to the vibration, a replacement time is exceedingly reduced to a time required for detaching and attaching the turntable 10.

The turntable 10 is then slid in the x-axis direction or direction opposite therefrom (reverse x-axis direction) by the air cylinder 80, so that a desired one of the concentric circles C1 to C4 is located at the receiving position P. The turntable 10 is intermittently rotated by the specified angle by the air motor 40. The waterproof plug 2 is picked up by the pin member 111 of the conveying device 110 moved downward and upward as shown in FIG. 9 each time the rotation of the turntable 10 is stopped, and is then transferred to the attaching device by moving the pin member 111 in the x-axis direction. After the waterproof plug 2 is transferred to the attaching device, the pin member 111 is again moved back to the receiving position. In this cycle, the waterproof plugs 2 are received and conveyed one by one. Since the air motor 40 rotates the turntable 10 by the specified angle while the pin member 111 conveys the waterproof plug 2 to the attaching device and comes back to the receiving position, the pin member 111 which has come back to the receiving position is permitted to immediately start moving downward to pick up the next waterproof plug 2. After all the waterproof plugs 2 arranged on one concentric circle are picked up, the air cylinder 80 slides the turntable 10 in the x-axis direction so that the next concentric circle is located at the receiving position.

The foregoing embodiment demonstrates the following effects:

a) In the conventional parts feeders, improper feeds have occurred. Namely, the waterproof plugs fall forward since the waterproof plugs are fed while being pushed forward by the succeeding ones. However, in this embodiment, since the waterproof plugs 2 are supplied while being individually accommodated in the recesses 12, they can be securely supplied to the receiving position.

b) Since the waterproof plugs are not supplied along the guide unlike the conventional parts feeder, it is not necessary to form in the waterproof plug a sliding portion of synthetic resin to facilitate the guiding. Thus, the production cost for the waterproof plugs is not increased.

c) Since a desired recess 12 can be moved to the receiving position by the air cylinder 80 and the air motor 40, all the waterproof plugs 2 can be picked at a single set receiving position.

d) Particularly, since the waterproof plugs 12 are orderly arranged, it is sufficient for the air cylinder 80 and the air motor 40 to move the turntable 10 at a specified feed pitch corresponding to the arrangement pitch of the waterproof plugs 2.

e) Since the turntable 10 is detachably mountable, the change in the kind of the waterproof plugs 2 can be coped with only by replacing the turntable 10. Thus, the replacement can be easily made within a short period of time. Further, the conventional parts feeders correspond to a particular kind of the waterproof plugs 2, and a plurality of kinds of the conventional parts feeders need to be prepared in order to handle different kinds of the waterproof plugs 2. This leads to a considerable increase in an installation cost. However, in this embodiment, the change in the kind of the waterproof plugs 2 can be coped with only by preparing a plurality of turntables 10, thereby greatly reducing the installation cost.

f) The use of the turntable 10 brings about the following advantage: Since the recesses 12 on each of the concentric circles C1 to C4 are moved to the receiving position, it is sufficient for the turntable 10 to rotate at the same position, thereby obviating the need to move the turntable 10 in a direction normal to the x-axis. Thus, a small space is required for the turntable 10.

g) There are prepared a plurality of turntables 10 having the recesses 12 of different shapes and different sizes corresponding to the different kinds of the waterproof plugs 2, and the recesses 12 in each turntable 10 are arranged and formed such that the waterproof plugs 2 are located at the same positions and the upper faces thereof are at the same height regardless of which turntable 10 is used. The above brings about the following advantage: The operation of the air cylinder 80 and air motor 40 needs not be changed when the turntable 10 is replaced in changing the kind of the waterproof plugs 2. The preparation for this purpose is not necessary.

The invention is not limited to the foregoing embodiment. The mechanism for sliding the turntable 10 by means of the air cylinder 80 may be omitted, in which case as many receiving positions of the conveying device 110 as the concentric circles C1 to C4 should be set instead. In this case, the receiving position is changed from one to another by changing a shifting amount of the air cylinder 114 of the conveying device 110. Although the turntable 10 is employed in the foregoing embodiment, a rectangular palette may be employed instead. Each recess is brought to the receiving position by sliding this palette in the longitudinal and lateral directions.

Further, an electric motor may be employed in place of the air motor and a known feed screw mechanism driven by an electric motor may be employed in place of the air cylinder.

Furthermore, the invention may be embodied in several forms without departing from the spirit and scope thereof.

What is claimed is:

1. A method of supplying parts sequentially to a conveyance apparatus, comprising the following steps:

providing a supply table having an upper surface with a plurality of recesses arranged in a specified pattern, each said recess being dimensioned to accommodate one of the parts, placing a plurality of said parts in an unarranged manner onto said upper surface of said supply table, vibrating the supply table so that said plurality of said parts are accommodated in said recesses, sequentially shifting said supply table in accordance with said specified pattern such that said parts in said recesses are sequentially supplied one at a time to the conveyance apparatus, and operating said conveyance apparatus for sequentially removing said parts one at a time from said recesses.

2. A method according to claim 1, wherein the step of vibrating the supply table and the step of shifting the supply table are carried out at places spaced from one another, said method further comprising the step of:

transferring the supply table from the place of vibration to the place where the parts are shifted and picked up by the conveyance apparatus.

3. A method according to claim 1, further comprising the steps of:

providing a plurality of different supply tables formed at their respective upper surfaces with different kinds of recesses, respectively, so as to accommodate different kinds of parts, and selecting an appropriate supply table for accommodating a particular kind of part.

4. A supplying device for supplying parts to a conveyance apparatus for receiving and conveying the parts, comprising:

a supply table having an upper surface with a plurality of recesses arranged in a specified manner, each said recess being dimensioned to accommodate one of the parts, vibration means for giving to the supply table a sufficient vibration to cause a plurality of the parts supplied on the upper surface of the supply table to move and become accommodated in the respective recesses, support means for detachably supporting the supply table, and shift means for intermittently moving the support means so that a desired recess of the support table can be located at a specified receiving position (P) of the conveyance apparatus so that each part is sequentially conveyed one at a time by the conveyance apparatus from the supply table.

5. A supplying device according to claim 4, wherein the parts are cylindrical waterproof plugs, and the recesses are cylindrical and are dimensioned for receiving the plugs.

6. A supplying device for supplying parts to a conveyance apparatus for receiving and conveying the parts, comprising:

a turntable having an upper surface with a plurality of recesses, the recesses being arranged circumferentially at a pitch determined by a specified angle on arcs of a plurality of concentric circles centered on a longitudinal axis, a vibration means for giving to the turntable a sufficient vibration to cause a plurality of the parts supplied on the upper surface of the turntable to move and become accommodated in the respective recesses, support means for detachably supporting the turntable, and shift means for intermittently moving the support means so that a desired recess of the turntable can be located at a specified receiving position of the conveyance apparatus, the shift means including drive means for intermittently rotating the turntable about the longitudinal axis by the specified angle and slide means for radially sliding the turntable.

7. A supplying device according to claim 6, wherein:

said turntable comprises a plurality of interchangeable turntables including recesses having different shapes and sizes corresponding to different kinds of parts, and the recesses are arranged at the same positions in each of the different interchangeable turntables.

8. A supplying device according to claim 7, wherein the depth of the recesses in the different turntables is set such that the upper faces of the parts accommodated in the recesses are at the same height whatever turntable is used.

9. A supplying device for supplying parts to a conveyance means for receiving and conveying the parts, comprising:

a turntable having an upper surface with a plurality of recesses arranged circumferentially at a pitch determined by a specified angle on arcs of a plurality of concentric circles centered on a longitudinal axis, said recesses being dimensioned to accommodate the parts;

support means for supporting the turntable such that the turntable is detachably mounted on the support means, said support means being rotatable about the longitudinal axis; and shift means for moving the turntable so that a desired recess can be located at a specified receiving position of the conveyance means, the shift means comprising drive means for intermittently rotating the turntable about the longitudinal axis by the specified angle (θ), the shift means further comprising slide means for radially sliding the turntable.

10. A supplying device according to claim 9, comprising a plurality of interchangeable turntables, the recesses of at least one said interchangeable turntable being sized and shaped differently from the recesses of the other of said interchangeable turntables for receiving parts of different sizes and shapes, the recesses being arranged in the same relative positions on each of said interchangeable turntables.

11. A supplying device according to claim 9, wherein the depth of the recesses in the different turntables is set such that upper faces of the parts accommodated in the recesses are at the same height for each turntable for facilitating reception of said parts by said conveyance means.

12. A supplying device according to claim 9, further comprising vibration means for selectively giving to the turntable a sufficient vibration that a plurality of parts supplied on the upper surface of the turntable move into the recesses.

* * * * *